United States Patent [19]

Baldus

[11] 4,169,361

[45] Oct. 2, 1979

[54] METHOD OF AND APPARATUS FOR THE GENERATION OF COLD

[75] Inventor: Wolfgang Baldus, Pullach, Fed. Rep. of Germany

[73] Assignee: Linde Aktiengesellschaft, Wiesbaden, Fed. Rep. of Germany

[21] Appl. No.: 886,801

[22] Filed: Mar. 15, 1978

Related U.S. Application Data

[63] Continuation of Ser. No. 736,081, Oct. 27, 1976, abandoned.

[30] Foreign Application Priority Data

Oct. 28, 1975 [DE] Fed. Rep. of Germany ..... 2548240

[51] Int. Cl.[2] ..... F25D 9/00; F25B 43/00; F25B 39/02; F25B 41/06

[52] U.S. Cl. ..... 62/402; 62/503; 62/504; 62/511; 138/40

[58] Field of Search ..... 62/116, 210, 222, 402, 62/504, 511, 527, 115, 514; 138/40

[56] References Cited

U.S. PATENT DOCUMENTS

| | | | |
|---|---|---|---|
| 2,393,854 | 1/1946 | Carpenter | 138/40 |
| 2,990,698 | 7/1961 | Crotser | 62/511 |
| 3,283,524 | 11/1966 | Byron | 62/511 |
| 3,872,687 | 3/1975 | Bottum et al. | 62/503 |
| 3,889,485 | 6/1975 | Swearingen | 62/114 |

OTHER PUBLICATIONS

*Engineering Thermodynamics*, Textbook, Herman J. Stoever, copyright 1951 by John Wiley & Sons, pp. 381–383 & 354–357.

*Primary Examiner*—Lloyd L. King
*Attorney, Agent, or Firm*—Karl F. Ross

[57] ABSTRACT

Cold is generated, according to the invention, by compressing a refrigerant and expanding the refrigerant isentropically in a nozzle. Advantageously at least a part of the expanded refrigerant is passed in indirect heat exchanging relationship with the portion of the refrigerant prior to expansion. An expansion machine can be used to work-expand a portion of the compressed refrigerant with the expanded gas returned to the compressor. The balance of the compressed stream is expanded in the nozzle.

3 Claims, 4 Drawing Figures

METHOD OF AND APPARATUS FOR THE GENERATION OF COLD

This is a continuation of application Ser. No. 736,081, filed Oct. 27, 1976, now abandoned.

FIELD OF THE INVENTION

The present invention relates to a method of and to an apparatus for the generation of cold and, more particularly, to the production of cold in a substantially closed refrigerant cycle.

BACKGROUND OF THE INVENTION

The generation of cold is useful for many purposes. For example, it is employed in household refrigerators, air conditioning systems, industrial plants and the like, can be used to liquefy gases for rectification or storage and can be used to operate many devices which are more efficient at cryogenic temperatures. Such devices include, for example, superconductive electrical cables, cryogenic comminuting devices which embrittle a material before the milling thereof or the like. In addition cold-generating machines can be employed to maintain materials at low temperatures to protect them against deterioration or as part of a treatment, e.g. lyophilization or freeze drying, to preserve them.

The most common system in widespread use for the generation of cold is a refrigerant cycle which generally comprises a compressor, a cooler or condenser for the refrigerant downstream of the compressor, an expansion valve or throttle downstream of the cooler or condenser and a heat exchanger or evaporator in which heat is abstracted from the refrigerant. The heat exchanger or evaporator is connected to the input side of the compressor.

In an entirely different principle of operation, the compressed refrigerant can be cooled by permitting it to expand with so-called work-producing expansion, i.e. expansion in an expansion turbine against a load.

In throttled expansion, in which cooling occurs only when the gas to be expanded is cooled below its inversion temperature prior to expansion, the enthalpy during expansion is constant. The cooling is, therefore, the result of an increase in the potential energy of the gas molecules at the expense of their kinetic energy without the generation of cold in the sense of an enthalpy decrease. The resulting temperature reduction is, for a given pressure differential across the throttle, only relatively small.

A greater temperature drop is obtained with work expansion of a gas stream at the same pressure, the work expansion preferably being carried out nearly isentropically in the expansion machine. Thus not only is kinetic energy converted to potential energy, but additional cold is generated by the transformation of kinetic energy into mechanical work. The temperature reduction is here a function of the enthalpy difference in the gas stream before and after expansion.

In cold technology, especially in the technology of generating very low temperatures, e.g. temperatures at cryogenic levels, both thermodynamic principles have been used in the Linde process and in the process developed by Georges Claude. Both processes are substantially equivalent when high pressures and low temperatures are involved.

In the Linde process, the generation of low temperatures is effected exclusively by isenthalpic expansion of the gas stream to be cooled whereby the expanded gas stream is used to precool the not yet expanded gas. The advantage of the Linde process lies in the simple structure of the apparatus with which it can be practiced since, aside from the circulating compressor, no machinery with moving parts is necessary. The disadvantage, however, lies thermodynamically in the relatively low cold generation per circulated standard cubic meter of refrigerant because the cooling is a function exclusively of the isenthalpic, i.e. irreversible, expansion of the gas stream to be cooled.

In the Claude process, a partial stream of the gas to be cooled is work-expanded in an expansion machine, e.g. an expansion turbine, and is used to precool the remainder of the gas stream to be cooled. The latter gas stream is then expanded isenthalpically to the end pressure of the refrigerant-circulating path. The advantage of this process resides in the relatively deep cooling which can be obtained in the expansion machine by the work expansion of the partial stream. A disadvantage, however, lies in the need for the expansion machine, i.e. an additional machine with moving parts.

It should be noted, in connection with the use of expansion machines such as expansion turbines, that it is generally not possible to expand therein a gas phase which contains liquid droplets or a gas phase which may develop liquid droplets upon cooling within the expansion machine, since the presence of such droplets can damage the vanes and other parts of the turbine.

OBJECTS OF THE INVENTION

The principal object of the present invention is to provide a process for the production of cold which can be carried out with simple means and, in spite of its simplicity, affords a large cold output.

Another object of the invention is to provide a method of and an apparatus for the production of cold which obviates the aforementioned disadvantages and provides a highly efficient and effective cold-generating system for a wide variety of purposes.

SUMMARY OF THE INVENTION

The present invention is based upon my discovery that a significant improvement in the cold output of a cold-generating cycle of the aforedescribed type can be obtained when the compressed refrigerant gas is expanded in a nozzle and, most advantageously, is expanded nearly isentropically in a nozzle. The term nozzle as here used is intended to describe a nozzle of the Laval or like type in which a space of small volume and cross section on the upstream side is separated from a large-volume, progressively widening, space at the downstream side by a narrow throat.

The invention makes it possible to generate cold with high output without the use of an expansion machine and affords the additional advantage that the expansion can take place under conditions which produce liquefaction without problems. It has already been pointed out that expansion in a state which produces a liquid phase is disadvantageous when carried out with expansion machines.

According to another feature of the invention, at least a part of the expanded refrigerant is used for the cooling of the not yet expanded refrigerant. This permits still lower temperatures to be obtained and enables the system to be shifted to the two-phase region were liquefaction occurs in the expansion nozzle.

Still another feature of the invention resides in the work expansion of a partial stream of the compressed refrigerant in an expansion machine and using this work-expanded portion for the precooling of the balance of the compressed gas which is subsequently expanded in the nozzle. This permits a combination of the thermodynamic advantages of work expansion with nozzle expansion.

The process of the present invention can be carried out in a single stage compression cycle or in a cascade cooling cycle of conventional construction except that the throttle valves used to isenthalpically expand the refrigerant in the conventional cycle are replaced by nearly isentropic expansion nozzles. Because the process of the invention can be carried out with considerable simplicity it can be used for relatively small refrigerating units e.g. household refrigerators, air conditioners and the like.

However, the system is also suitable for use in the Linde or Claude processes, i.e. in apparatus for the liquefaction of helium or other low-boiling-point gases. In such systems as well the throttle valves are replaced by expansion nozzles in which the refrigerant is preferably isentropically expanded as described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
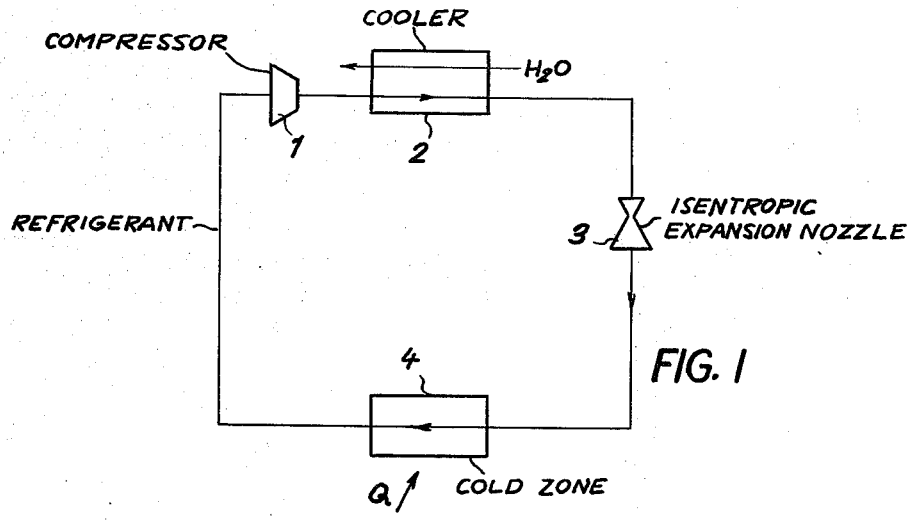
FIG. 1 is a schematic diagram illustrating the process of the present invention.

FIG. 1 shows the basic elements of an apparatus for carrying out the process of the invention in which a refrigerant, e.g. ammonia, a hydrocarbon, a fluorochlorocarbon or a mixture of different hydrocarbons having different boiling points, is compressed to an elevated pressure in a compressor 1.

The compression heat is abstracted from the refrigerant in a cooler 2 and the latter can be traversed by water or other cooling medium. The refrigerant is then introduced into a nozzle 3 in which it is preferably expanded as isentropically as possible and is thereby cooled, preferably to a two-phase state consisting of the liquefied gas and the unliquefied gas.

This low temperature refrigerant is then supplied to a cold consumer 4 which may be a refrigerating chamber or other system to be cooled. In this unit 4, a quantity of heat Q is absorbed by the refrigerant which is returned to the compressor 1.

Figure 2:
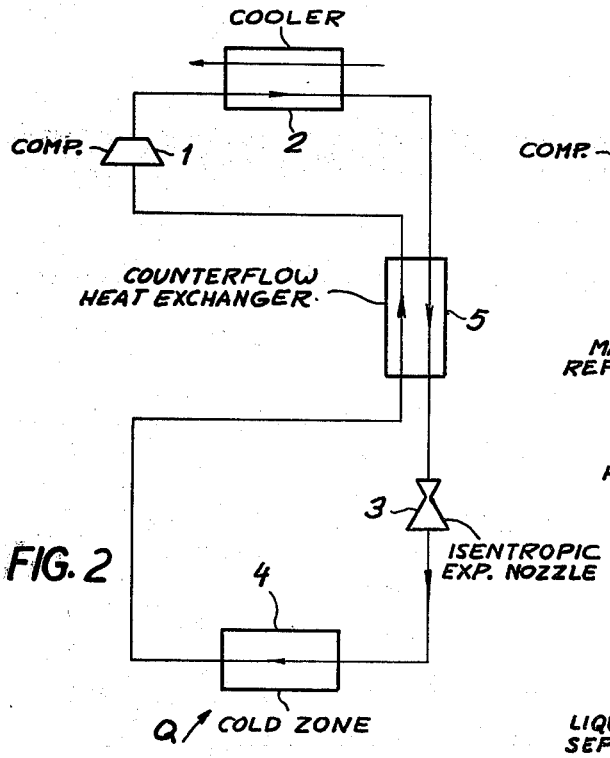
FIG. 2 is another embodiment of the system.

A more efficient system using the same principles has been illustrated in FIG. 2 in which the refrigerant, prior to its expansion in the nozzle 3, is precooled by the residual cold contained in the gas passing from the cold consumer 4. The precooling is carried out in the counterflow indirect heat exchanger 5.

Figure 3:
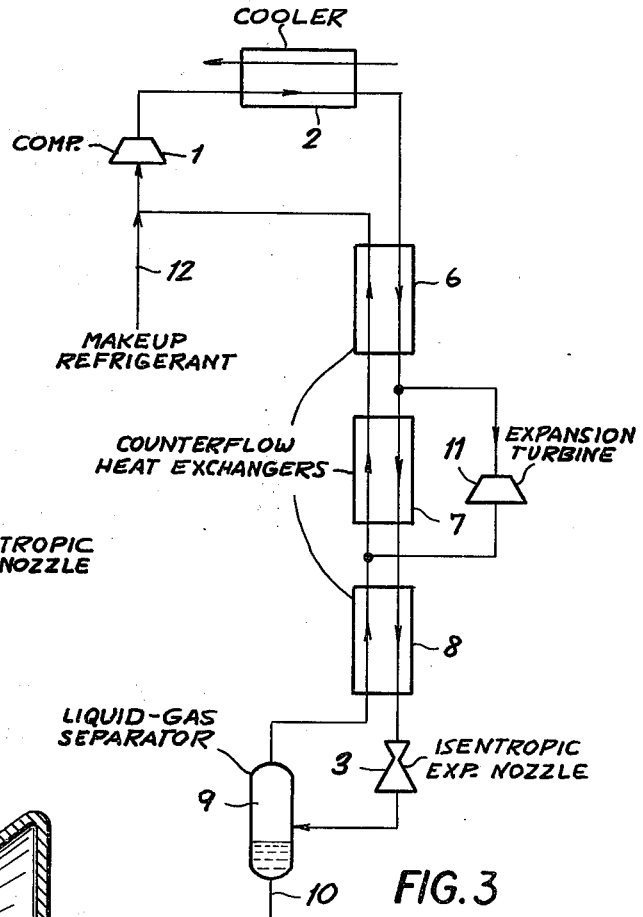
FIG. 3 represents a third embodiment.

FIG. 3 illustrates a so-called open cycle in which a liquefied refrigerant, e.g. a low-temperature, low-boiling-point gas such as air, nitrogen, oxygen, helium, can be recovered in a liquid state.

After compression in the compressor 1 and cooling in the water-cooled heat abstracter 2, the compressed fluid is passed in succession through three counterflow heat exchangers 6, 7, 8 to be further cooled and then expanded in the nearly isentropic expansion nozzle 3.

Between the counterflow heat exchanger 6 and the heat exchanger 7, a portion of the compressed gas is bypassed to an expansion turbine 11 and the low-temperature expanded gas is fed to the return line between the heat exchangers 7 and 8. The balance of the compressed gas stream is nearly isentropically expanded in the nozzle 3. The expansion in nozzle 3 produces a two-phase mixture of liquid and gas as described, and the liquid phase is recovered in the liquid-gas separator 9 from which the liquid oxygen, air or helium can be discharged at 10. The gaseous phase is returned through heat exchangers 8, 7 and 6 in succession to the input side of the compressor 1. Make-up refrigerant or fluid is supplied at 12 to the compressor to compensate for liquid removed from the cycle. The expansion gas stream from the turbine 11 and the return gas stream from the separator 9 are combined in the heat exchangers 7 and 6 and travel together through the latter, being warmed therein in indirect counterflow heat exchange with the compressed gas to be cooled.

Figure 4:
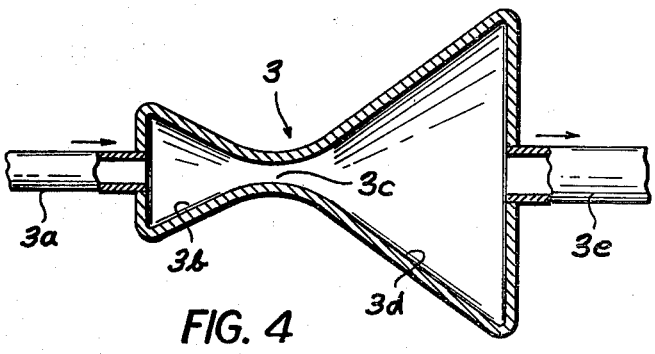
FIG. 4 is an axial cross-sectional view of a nozzle which can be used in accordance with the present invention.

FIG. 4 shows an expansion nozzle according to the invention which can be used in the embodiments of FIGS. 1-3. This nozzle 3 combines an inlet pipe 3*a* communicating with a small-cross-section chamber 3*b* terminating in a Laval-type nozzle throat 3*c* which opens into an outwardly flared or widened chamber 3*d*. The chamber 3*d* communicates via a pipe 3*e* with the components downstream of the nozzle.

I claim:

1. An apparatus for the generation of cold on a very low temperature level, comprising:
   - a compressor for compressing a low-boiling gaseous coolant;
   - a cooler downstream of said compressor for abstracting compression heat from the compressed gaseous coolant;
   - a counterflow heat exchanger downstream and in addition to said cooler for exchanging heat between said compressed gaseous coolant and a cold gaseous low-pressure coolant;
   - an expansion nozzle downstream of said heat exchanger for expanding and partially liquefying the compressed gaseous coolant substantially isentropically to produce a cold partially liquefied fluid;
   - a cold consumer downstream of said expansion nozzle for transferring heat to said cold partially liquefied fluid;
   - means for returning the part of said fluid leaving the cold consumer in the gaseous state to the counterflow heat exchanger as said cold gaseous low-pressure coolant; and
   - an expansion turbine connected ahead of said nozzle for work-expanding a portion of the compressed gaseous coolant, the balance of the compressed gaseous coolant being substantially isentropically expanded in said nozzle.

2. The apparatus defined in claim 1, further comprising a liquid-gas separator downstream from said expansion nozzle for separating said fluid into a liquid phase and a gas phase, the gas phase being returned as said cold gaseous low-pressure coolant to said counterflow heat exchanger.

3. In a method for the generation of cold at a very low temperature level in which a low-boiling coolant is liquefied, the method comprising the steps of:

compressing the low-boiling gaseous coolant quasi-isothermically;.

removing the heat of compression of the compressed gaseous coolant by cooling same;

cooling further the compressed gaseous coolant by passing it in countercurrent heat exchange with a cold gaseous low-pressure coolant;

expanding and thereby partially liquefying the compressed coolant cooled by countercurrent heat exchange; and using the part of the coolant remaining in the gaseous state or the part of the liquiefied coolant re-evaporating during heat exchange with a heat consumer as the cold gaseous low-pressure coolant in the countercurrent heat exchange, the improvement which comprises:

expanding and partially liquefying said cold compressed coolant in an expansion nozzle substantially isentropically during the expansion and partial liquefaction step, a portion of the compressed coolant being work-expanded in an expansion machine while the balance of the compressed coolant is expanded in said nozzle.

* * * * *